United States Patent [19]

Caniglia

[11] Patent Number: 4,457,643

[45] Date of Patent: Jul. 3, 1984

[54] SPONGE FOR CONTAINING SOAP

[76] Inventor: Joseph E. Caniglia, 5368 E. 134th St., Garfield Heights, Ohio 44125

[21] Appl. No.: 380,822

[22] Filed: May 21, 1982

[51] Int. Cl.[3] ..... A47K 7/02

[52] U.S. Cl. ..... 401/201; 401/6; 401/200; 401/226

[58] Field of Search ..... 401/201, 266, 200, 261, 401/7, 8, 6; 15/244 C; 150/7

[56] References Cited

U.S. PATENT DOCUMENTS

| | | | |
|---|---|---|---|
| 837,759 | 12/1906 | Weston | 401/201 |
| 1,469,917 | 10/1923 | Dessau | 401/201 |
| 1,577,861 | 3/1926 | Henry | 401/201 |
| 1,748,406 | 2/1930 | Blair | 401/201 |
| 1,909,966 | 5/1933 | Jones | 401/201 |
| 1,912,224 | 5/1933 | Schimel | 401/201 |
| 2,588,773 | 3/1952 | Smith | 401/201 |
| 2,829,392 | 4/1958 | Dupuy | 401/201 |
| 2,986,762 | 6/1961 | Webb | 401/6 |
| 4,059,222 | 11/1977 | Gamble | 150/7 X |

*Primary Examiner*—Steven A. Bratlie

*Attorney, Agent, or Firm*—Maky, Renner, Otto & Boisselle

[57] ABSTRACT

A soap and sponge washing device, for example, for washing the body in a shower or bath includes a container forming an envelope for a bar of soap, discrete openings through to the container interior allowing water access to the soap and the facile exiting of lather for washing purposes, and a tab-like locking strip integral with the container material for locking the soap in the container. Preferably there is a plurality of openings and preferably the tab lock is T-shape or truncated arrow-shape and is lockable into an opening in the container to block the entrance thereof.

11 Claims, 7 Drawing Figures

SPONGE FOR CONTAINING SOAP

TECHICAL FIELD

The present invention relates generally to a washing device, for example for washing the body in the shower or bath, and, more particularly, to a sponge container for containing soap to wash the body.

BACKGROUND OF THE PRIOR ART

In a typical bathtub or shower facility a soapdish is provided for containing the soap. Frequently the soapdish becomes dirty and requires separate cleaning. Frequently the soapdish has water in it tending to cause melting or other disintegration of the soap. Moreover, the wetness in such a soapdish tends to encourage formation of mold or mildew.

In the past sponge containers have been used for containing soap. The sponge material is porous and permits water to pass therethrough to wet the soap. Lather formed may exit also through the porous material. A disadvantage to the prior sponge containers for soap is that the porous material does not allow adequate water easily to reach the soap or the lather to pass through the sponge material to the surface for washing. Another disadvantage to the prior sponge containers for soap is the lack of air flow to the soap, whereby the soap tends to remain wet for a relatively long time; such wetness may substantially reduce the effective longevity of the soap and may contribute to accumulation of mold or mildew.

Another disadvantage with the prior sponge-like containers for soap is that the sponge material is relatively smooth or slippery, especially when wet, and sometimes does not provide the desired roughness for efficient effective washing.

Another problem encountered with prior sponge containers for soap has been the inability easily to retain the soap in the hollow interior of the envelope-like sponge container. One approach to retain the soap in the container has been to use rigid fasteners to close the entranceway at one end of the container, but such rigid fasteners may scratch or otherwise injure a person using the container and, if metal, may tend to corrode. Another approach to secure soap inside such a sponge container has been to provide a narrow entrance to the container interior with such entrance being resiliently expandable under force to allow the soap entry. A disadvantage with the latter approach is that the soap bar may squirt out from such opening, especially as the soap becomes smaller with use. Still another approach for holding soap inside a sponge container has been to provide a flap in a surface of the container, but such flap too easily may open and release the soap.

Examples of prior sponge or sponge-like containers for containing soap or soap-like material are U.S. Pat. Nos. 837,759; 1,577,861; 1,748,406; and 1,909,966.

BRIEF SUMMARY OF INVENTION

The invention will be described below with reference to a container made of sponge material to contain a bar of soap, the combination being useful to wash during showering, bathing or the like. Although sponge material is the preferred material, equivalent materials may be used. Preferably such material is porous, although by using the openings of the invention, as are described in greater detail below, such material need not necessarily be porous. Further, the preferred soap-like material employed in the invention is a conventional bar of soap used in the domestic household. However, it will be appreciated that other types of soap or soap-like material may be employed in accordance with the invention.

Briefly, according to one aspect of the invention, there is provided a washing device including a container for forming an envelope for soap-like material and discrete openings through at least one wall of the container to permit lather to exit the container. According to another aspect of the invention a tab-like locking device integral with the container material and insertable into a locking opening is provided for locking the soap-like material in the container. Still another aspect is the combination of such container with a bar of soap.

The discrete openings or holes through the container between the bar of soap containing interior and the exterior thereof not only facilitate lather exiting the container but also facilitates water access to the soap for lathering, air access to the soap and to the interior of the sponge material for expedited drying and hanging the container for storage. The tab-like lock is integral with the container material, actually being formed thereof, so that separate fasteners that may scratch are unnecessary. Moreover, the lock is centrally located in the entrance to the container interior, thus assuring long term secure retention of soap therein. Such long term retention especially is possible due to the facility with which the container and soap may dry, thus increasing the longevity of the soap.

Several advantages inure to the invention. Safety is enhanced because the possibility of slipping on the containerized soap is much less than that of slipping on a free bar of soap. Hygiene is improved because of the washing surface available and the roughened area for scrubbing afforded by the relatively sharply defined edges of the holes through the container. Using the invention a washing or scrubbing action similar to that obtained using a washcloth is obtained without requiring a washcloth, and this together with the ease with which the invention may be held tends to expedite showering and/or bathing, which may be a conservation measure in the sense that the quantity of water required for washing will generally be reduced.

With the foregoing and the following detailed description in mind, a primary object of the present invention is to improve hygiene.

Another object is to improve the convenience of storing soap.

An additional object is to facilitate drying of soap after use.

A further object is to improve the longevity of soap.

Still another object is securely to lock soap within a sponge container without requiring additional fastening material.

Still an additional object is to improve the safety in a bathtub, shower, or like environment.

Still a further object is to increase lather exposure for washing, especially while obtaining a washcloth type washing function without requiring a washcloth, and further especially using a sponge-like container for containing soap during use thereof.

Yet another object is to minimize the cost for a sponge-like container for containing soap.

Yet an additional object is to facilitate holding a sponge-like container for soap with the soap therein.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
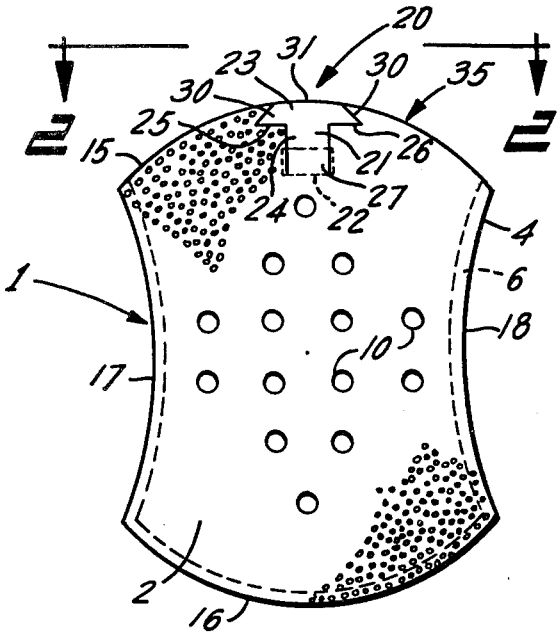
FIG. 1 is a front plan view of a sponge container in accordance with the present invention for containing soap therein.
Figure 3:
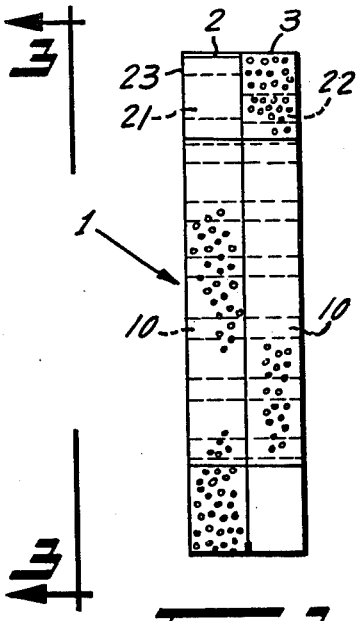
FIGS. 2 and 3 are top and side views of the container of FIG. 1.
Figure 2:
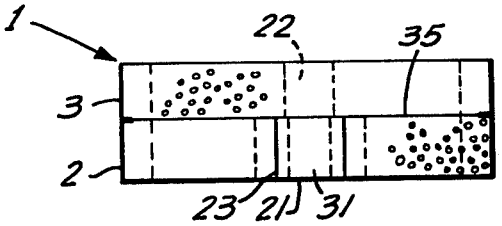

Referring in detail to the drawing, wherein like reference numerals designate like parts in the several figures, and initially to FIGS. 1–4, a container 1 in accordance with the present invention for containing a bar of soap is shown. The container 1 is formed of a pair of generally flat sponges 2, 3 cut out in the pattern shown. The sponges 2, 3 are sealed together about the perimeter 4 of three sides to form or otherwise bound a hollow interior 5. The seal 6 may be of tape, adhesive, solvent, etc., effective to provide relatively strong securement of the two sponges to form an envelope-like structure within which the soap 7 (FIG. 4) may be retained.

Preferably, although not necessarily, the material of which the sponges 2, 3 is formed is the same type. Such material preferably is conventional artificial sponge material that is porous to water and air, on the one hand, but also provides a retentive capacity for water in the porous zones thereof. Although the container 1 is illustrated being formed of a pair of sponges 2, 3, which are fastened together about the perimeter 4, it will be appreciated that the container 1 may be formed of a single sponge that is slit in part or otherwise formed to make the hollow interior 5. In the latter event, the seal 6 provided about the perimeter 4 may be essentially the integrity of the material itself; alternatively, during the slitting the sponge may be slit at the edges and a tape, adhesive, solvent, etc., seal subsequently provided to provide an edge boundary about a substantial portion of the hollow interior 5.

Importantly, a plurality of discrete openings or holes 10 are provided through the sponges 2, 3. If desired, the openings may be only in one sponge, although in the preferred embodiment the openings should be in both sponges. The openings 10 extend from the exterior surface 11 and, thus the exterior of the container 1, through to the interior surface 12 (FIG. 4) of the container and, thus, to the hollow interior 5 thereof. The discrete openings 10 are relatively large, especially compared to the ordinary porous pathways or chambers in the material of which the sponges 2, 3 are formed. Moreover, preferably the openings are in a regular pattern allowing adequate space between openings for strength of the container 1, and the openings 10 in one sponge, say the sponge 2, preferably are aligned with the openings in the other sponge so that the openings can be cut using a single die passing all the way through the container 1 during manufacturing thereof. The openings may be of circular cross-section as is shown or may be of other cross-section forms, such as triangular, square, pentagonal, hexagonal, etc.

The openings 10 provide a plurality of functions. For example, the openings 10 provide a large area through which lather may exit the hollow interior 5 for washing purposes, the lather then being easily accessible and applicable to a person's body for washing. The openings 10 also facilitate passing water to the interior 5 for generating the lather. Further helping to generate the lather, the boundaries of the openings 10 where they meet the interior surface 12 are relatively sharply defined to help obtain a rubbing action as the sponge material is deformed with the soap therein tending to cause a lathering effect. The openings 10 enable air to reach the soap during storage after use so that drying of the soap can be expedited and so that the surrounding sponge material drying will be expedited. As a result, longevity of the soap is enhanced and the possibility of mold or mildew accumulating is appreciably reduced. The openings 10 also may be employed for facilitating hanging the container 1 on a hook while the soap is retained in the container; such storage does not require a soapdish, usually would assure good air flow for expedited drying, and would permit storage in a relativley convenient and small area so that each person in a family, for example, may have a personal container 1 with soap therein. Another function of the openings 10 is the relatively sharply defined boundary thereof with the exterior surface 11 of the container 1 whereby a certain added abrasiveness is provided to enhance the rubbing or scrubbing of the lather onto a person's body for cleaning purposes. The openings 10 even without such sharply defined boundary with the exterior surface 11 help to provide a certain abrasive action or generally discontinuous surface areas that improve scrubbing action.

As in seen in FIG. 1, the container 1 is convexly curved at the entrance end 15 and at the relatively opposite or closed end 16. Such convex curvature tends to distribute forces in the event that the container 1 with soap 7 therein were to be dropped preventing injury to a user and/or to the floor surface. Such force distribution also improves the longevity of the container 1 and of the soap 7 preventing damage or injury thereto. On the other hand, the sides 17, 18 of the container 1 are concavely curved providing a relatively narrower cross-section area for facilitating secure grasping of the container 1 during use. Such secure grasping helps to expedite the washing process. Moreover, such secure grasping reduces the possibility of dropping the container 1 and provides an added measure of control thereof which may be particularly useful when employing the container 1 with soap therein to wash an infant, for example.

The interior 5 of the container 1 is open or unsealed at the entrance end 15 to enable a bar of soap or the like to be inserted into the interior. However, a tab-like locking mechanism 20 at the entrance end 15 is used to lock the bar of soap 7 in the interior 5. The locking mechanism 20 includes a tab 21 and a lock opening 22. The tab 21 and lock opening 22 are integral with the container 1 meaning that preferably the tab 21 is actually cut from the material of which the sponge 2, for example, is formed and the lock opening 22 is cut out from the sponge 3. No additional materials are required to form the tab-like locking mechanism 20 other than the materials of which the sponges 2, 3 (or an integral sponge) of which the container 1 is formed. The tab 21 has an enlarged head 23 extending from a stem 24. The tab is cut from the sponge 2 along the lines 25, 26 (FIGS. 1 and 7) and is fastened along the base 27 of the tab to the major extent of the sponge 2. The enlarged head 23 is truncated triangular shape or T-shape in the manner shown preferably providing prong-like portions 30 to help secure the tab in the lock opening 22. Preferably the enlarged head 23 is tapered having a relatively narrower leading end 31 to facilitate inserting the tab into and through the lock opening 22, which preferably has a smaller cross-sectional area or diameter than the distance between the respective prong portions 30 at opposite sides of the tab 21. Since the tab 21 and lock opening 22 are integral portions of the sponges 2, 3, the same are generally resilient in the same manner as the sponges 2, 3, thus enabling the enlarged head 23 to be pulled fully through the lock opening 22. After such an insertion of the head 23 fully through the lock opening 22, the prong portions 30 resist withdrawal of the enlarged head 23 back through the lock opening 22. With the enlarged head 23 of the tab 21 secured through the lock opening 22, the tab 21 blocks the entrance opening 35 into the hollow interior 5 of the container 1 preventing the soap 7 from inadvertently falling out of the container.

Figure 5:
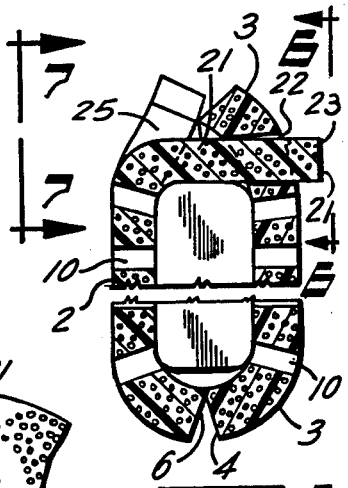
FIG. 5 is a section view through the side of the container of FIG. 1 having a bar of soap therein and showing the tab-like locking mechanism.
Figure 6:
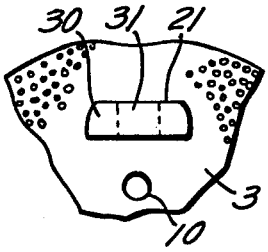
FIGS. 6 and 7 are fragmentary front and back views looking generally in the direction of the arrows 6—6 and the arrows 7—7, respectively, of FIG. 5.
Figure 7:
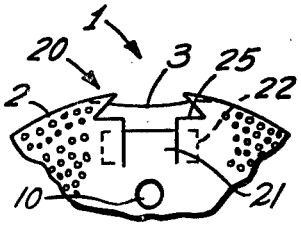

Turning, now, to FIGS. 5, 6 and 7, the tab-like locking mechanism 20 of the invention is illustrated in detail. In particular, the tab 21 is shown with the enlarged head 23 passed fully through the lock opening 22 and secured therein by the prong portions 30. It is noted here that although the lock opening 22 is shown rectangular in the drawing, such lock opening may be circular or other configuration, as may be desired, and such lock opening also may be of the same size or of a different size than the openings 10.

Figure 4:
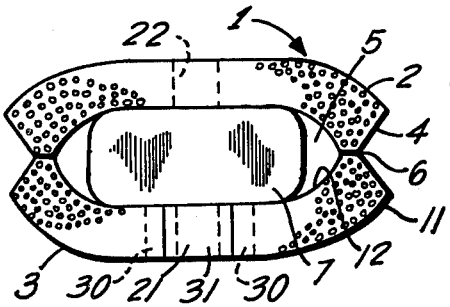
FIG. 4 is a section view through the container of FIG. 1 with a bar of soap in the hollow interior thereof.

During use of the container 1, with the tab-like lock mechanism 20 unlocked allowing free access through the entrance opening 35 to the interior 5, a bar of soap 7 may be inserted to the position shown, for example, in FIGS. 4 and 5. Thereafter, the tab-like locking mechanism 20 may be closed through the manner shown in FIGS. 5, 6 and 7, securing the bar of soap 7 in the hollow interior 5. Then, the container 1 with soap 7 therein may be wet with water and used to generate a lather and to apply the lather with a scrubbing action to the body of a person for washing. It will be appreciated, too, that the invention may be used for washing surfaces other than the body of a person in the same manner that soap and/or a wash fabric, cloth, rag, etc., are used.

I claim:

1. A washing device, comprising container means for forming an envelope for soap-like material, said container means comprising two substantially parallel walls of porous resilient material forming therebetween an interior area to contain such soap-like material, and discrete opening means through said walls of said container means for permitting lather to exit said container means, entrance means at an end of said container means for permitting insertion and removal of such soap-like material with respect to said interior area, and tab-like locking means integral with said container means for locking soap-like material therein, said tab-like locking means comprising a tab cut directly from the material of which one of said parallel walls of said container means is formed and a lock opening cut through the material of which the other of said parallel walls of said container means is formed and aligned with respect to said tab-like locking means to pass the latter therethrough to secure said tab-like locking means therein, said tab-like locking means having a relatively narrow stem portion and a relatively enlarged head portion, said head portion being resiliently deformable to pass through said lock opening and thereafter expandable to a size larger than said lock opening thereby to lock said tab with respect to said lock opening, said stem portion supporting said head portion with respect to said one of said parallel walls, said container means having a perimeter edge portion of a first pair of generally parallel edges and a second pair of generally parallel edges, said first pair of edges being generally orthogonal to the second pair of generally parallel edges, said entrance means being in one of said edges for permitting soap-like material to be inserted or removed with respect to said interior area, said pair of substantially parallel edges that are generally orthogonal to said one edge being curvilinearly concave with respect to the approximate center of said container means to provide a tapered cross-section to facilitate manual grasping of the device, said tab being cut directly from one of said two substantially parallel walls proximate said one edge, and said lock opening being cut out from the other of said two substantially parallel walls proximate said one edge.

2. The device of claim 1, said tab being generally arrow shaped.

3. The device of claim 1, said tab being generally T-shape.

4. The device of claim 1, said tab having a tapered configuration with a narrow leading end to facilitate insertion thereof through said lock opening.

5. The device of claim 1, further comprising soap in said container means.

6. The device of claim 5, said soap comprising a bar of soap.

7. The device of claim 1, said container means comprising sponge-like material of tapered cross-section to facilitate manual grasping.

8. The device of claim 1, said container means comprising two parts of sponge-like material fastened together about a substantial portion of the perimeter thereof and leaving open said entrance means for inserting soap therein.

9. The device of claim 1, said opening means being of circular cross section.

10. The device of claim 1, said walls comprising a sponge-like material, said opening means passing through said sponge-like material, and said opening means having relatively sharp boundaries to enhance scrubbing type abrasiveness of the device.

11. The device of claim 1, said container means comprising sponge material.

* * * * *